US008671587B2

(12) United States Patent
Berends et al.

(10) Patent No.: US 8,671,587 B2
(45) Date of Patent: Mar. 18, 2014

(54) METHOD FOR IMPLEMENTING A DRYING PROGRAM SECTION IN WASHING EQUIPMENT WITH A CONDENSATION DRYING DEVICE

(75) Inventors: Erik Berends, Bielefeld (DE); Martin Kornberger, Bielefeld (DE); Dirk Wegener, Bielefeld (DE)

(73) Assignee: Miele & Cie. KG, Guetersloh (DE)

( * ) Notice: Subject to any disclaimer, the term of this patent is extended or adjusted under 35 U.S.C. 154(b) by 570 days.

(21) Appl. No.: 12/528,011

(22) PCT Filed: Feb. 6, 2008

(86) PCT No.: PCT/EP2008/000894

§ 371 (c)(1),
(2), (4) Date: Aug. 20, 2009

(87) PCT Pub. No.: WO2008/101597

PCT Pub. Date: Aug. 28, 2008

(65) Prior Publication Data

US 2010/0043250 A1 Feb. 25, 2010

(30) Foreign Application Priority Data

Feb. 21, 2007 (DE) ..... 10 2007 008 950

(51) Int. Cl.
*F26B 7/00* (2006.01)
*B08B 3/00* (2006.01)

(52) U.S. Cl.
USPC ..... 34/427; 134/56 D

(58) Field of Classification Search
USPC ..... 34/427; 134/56 D, 57 D, 58 D; 510/194, 510/220
See application file for complete search history.

(56) References Cited

U.S. PATENT DOCUMENTS

| | | | | |
|---|---|---|---|---|
| 3,024,074 | A | 3/1962 | Jacobs et al. | |
| 3,588,213 | A * | 6/1971 | Braga et al. | 312/228 |
| 5,881,746 | A * | 3/1999 | Buser et al. | 134/58 D |
| 2006/0283482 | A1 | 12/2006 | Berends et al. | |
| 2007/0267402 | A1 * | 11/2007 | Harned et al. | 219/392 |

FOREIGN PATENT DOCUMENTS

| | | |
|---|---|---|
| DE | 4404113 | 8/1994 |
| DE | 4443849 | 5/1996 |
| DE | 19818812 | 10/1999 |
| DE | 102005028448 | 12/2006 |
| EP | 0755652 | 1/1997 |
| EP | 1733675 | 12/2006 |
| FR | 2039346 | 1/1971 |
| GB | 2263969 | 8/1993 |
| GB | 2274772 | 8/1994 |
| JP | 08052103 | 2/1996 |

OTHER PUBLICATIONS

International Search Report for PCT/EP2008/000894, mailed Jun. 6, 2008.

* cited by examiner

*Primary Examiner* — Kenneth Rinehart
*Assistant Examiner* — John McCormack
(74) *Attorney, Agent, or Firm* — Leydig, Voit & Mayer, Ltd.

(57) ABSTRACT

A method for carrying out a drying step in a dishwasher that includes a housing, a washing tub, a door with a hinged lower region operable to close the washing tub, an opening device for automatically opening the door to an ajar position and a condensation drying system including a cooling-air flow generator. The method includes guiding a portion of a cooling-air flow along a portion of an underside of a countertop covering a top of the dishwasher housing both before and after the door is opened to an ajar position.

7 Claims, 2 Drawing Sheets

METHOD FOR IMPLEMENTING A DRYING PROGRAM SECTION IN WASHING EQUIPMENT WITH A CONDENSATION DRYING DEVICE

CROSS REFERENCE TO RELATED APPLICATION

This is a U.S. National Phase application under 35 U.S.C. §371 of International Application No. PCT/EP2008/000894, filed on Feb. 6, 2008, and claims the benefit of German Patent Application No. 10 2007 008 950.5, filed on Feb. 21, 2007. The International Application was published in German on Aug. 28, 2008 as WO 2008/101597 A1 under PCT Article 221(2).

FIELD

The present invention relates to a method for carrying out a drying step in a dishwasher including a condensation drying system having means for generating a cooling-air flow.

BACKGROUND

A dishwasher having a condensation drying system is described in DE 198 18 812 A1 or EP 0 755 652 A2. In this appliance, after completion of the water-using cycle steps, cooling air is drawn in by a fan in the lower region of the dishwasher and passed along the side surfaces of the washing tub for the purpose of drying the dishes. As a result, the moisture condenses from the warm moist process air within the washing tub, and collects as condensate in the lower region of the tub.

Other dishwashers (e.g., as described in DE 44 04 113 C2), mix the moist process air inside the washing tub with cold air from outside, and then discharge the air through an opening in the door.

In spite of the aforementioned drying systems, some users open the door after the water-using cycle steps end (generally after the rinse step), so as to achieve drying by convection. In the system described in DE 44 43 849 A1 the latch keeper of a dishwasher with a closing plate which is eccentrically mounted to a motor and thereby can automatically open the washing tub door to an ajar position after the wash cycle is complete. Although the mechanical or automatic opening of the door improves the drying process, problems still arise if the dishwasher is integrated into a row of kitchen units and covered by a countertop. In such conditions, the warm, moisture-laden air condenses on the underside of the cold countertop, which may result in its destruction.

Document JP 08 052 103 A describes a dishwasher in which the moist air from the washing tub is mixed with dry fresh air and discharged from the washing tub above the appliance door. An air duct branching off from the fresh-air intake fan leads into a second opening above the exhaust port. The aim of this is to prevent moisture from the washing tub from condensing on the edge of a countertop above the dishwasher housing. Since the fresh air being drawn in is cool, the dew point at the edge of the countertop is low. Therefore, a very large amount of fresh air must be discharged from the second opening, which impairs the drying performance inside the washing tub.

A domestic dishwasher 1 may include a washing tub 2 which can be closed at is front by a door 3, as is illustrated in FIG. 3. Door 3 is hinged in the lower region such that can pivot about a pivot axis 4. For purposes of stability, washing tub 2 is provided with a U-section metal cross-member 5 (see also FIG. 2). The outer leg 6 of cross-member 5, which is shown on the left in FIGS. 2 and 3, forms the front boundary line of appliance housing 8. The outer leg is provided with a seal 9 which engages the upper edge of door 3. For purposes of noise and thermal insulation, an insulating mat 10 is placed on the washing tub. Generally, a countertop 11 is located above dishwasher 1. The countertop is not part of the appliance, but of the row of kitchen cabinetry into which dishwasher 1 is integrated as a built-in or undercounter appliance. The front edge of countertop 11 projects over door 3 and will hereinafter be referred to as "overhang 12". The overhang may lie in the plane defined by the door front, or may project even further.

Dishwasher 1 further includes a condensation drying system for removing moisture from the warm, moist air that is present within the washing tub after the last water-using cycle step is completed. To this end, a fan 13 is provided in the lower side portion of dishwasher housing 8. The fan draws in cooling air (symbolized by arrows 15) through an opening 14 in appliance housing 8 below door 3 and passes it along a side wall of the washing tub. The cooling-air flow 15 is completely discharged at the rear, as shown in FIG. 3.

In order to improve the drying performance, dishwasher 1 is also equipped with a device for automatically opening the door to an ajar position at the end of the drying step, similar to that described DE 10 2005 028 448 A1. FIG. 4 shows the upper portion of dishwasher 1 in a slightly open condition. To allow the closing of washing tub 2, a forked latch member 16 is rotatably mounted on door 3. When in the latching position, the latch member is in engagement with a latch keeper 17 mounted on the washing tub. To open the door, a handle 18 is pushed upward, causing latch member 16 to be rotated (via a mechanism not shown) to a position in which it is no longer held by latch keeper 17. To enable door 3 to be opened in a program-controlled manner without actuation of handle 18, latch keeper 17 is attached to a closing plate 19 which can be linearly displaced by motor means over a distance of about ten centimeters in the opening direction of door 3. Motor 20 is energized by controller 30 of dishwasher 1 according to the programmed cycle.

SUMMARY

In view of the above an aspect of the present invention is to provide a method for carrying out a drying step in a dishwasher in a manner which reliably prevents condensate from forming on the underside of a countertop.

In an embodiment, the present invention provides a method for carrying out a drying step in a dishwasher that includes a housing, a washing tub, a door with a hinged lower region operable to close the washing tub, an opening device for automatically opening the door to an ajar position and a condensation drying system including a cooling-air flow generator. The method includes guiding, with the door in a closed position, a portion of a cooling-air flow along a portion of an underside of a countertop covering a top of the dishwasher housing. The door is opened to an ajar position. A portion of the cooling-air flow is guided along the portion of the underside of the countertop after the door is opened.

BRIEF DESCRIPTION OF THE DRAWINGS

An exemplary embodiment of the present invention is described in more detail below and schematically shown in the drawings, in which.

DETAILED DESCRIPTION

The method of the present invention has an advantage that the edge of the countertop is exposed to dry warm air and thereby pre-warmed before the door is opened to an ajar position. As a result, the dew point is raised, and condensation is reliably prevented.

Figure 2:
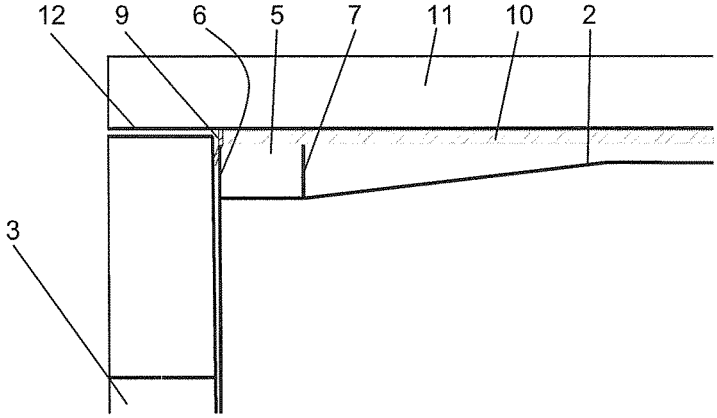
PRIOR ART Fig. 2
FIG. 2 is a view showing a portion of a dishwasher having an air flow path according to the prior art.
Figure 3:
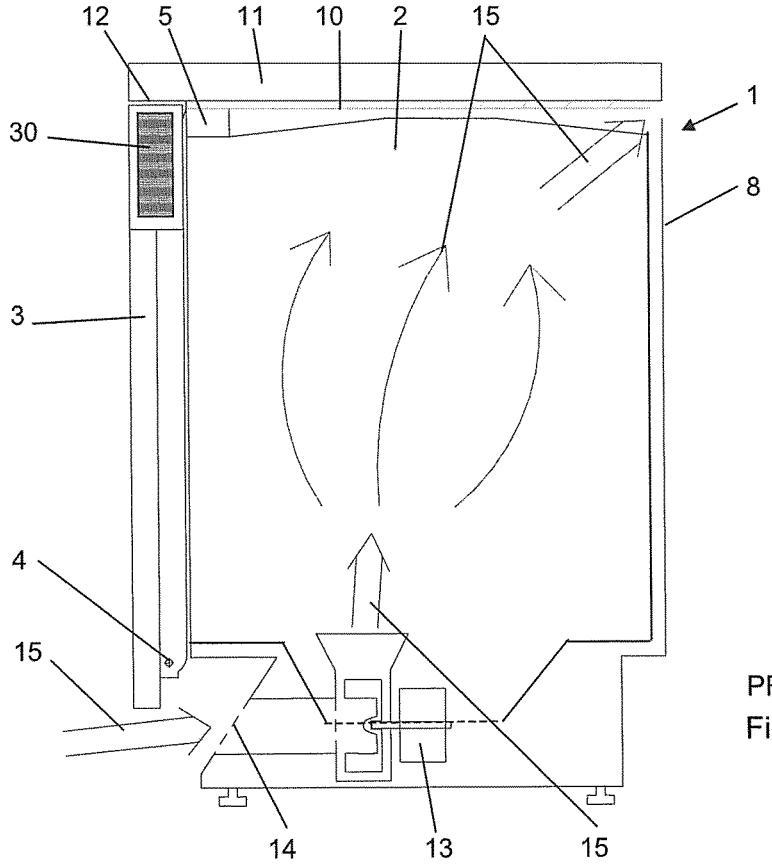
PRIOR ART Fig. 3
FIG. 3 is a view of a dishwasher having an air flow path according to the prior art.

Similar to that shown in FIG. 3, a domestic dishwasher 1 designed in accordance with the present invention includes a washing tub 2 which can be closed at its front by a door 3. Door 3 is hinged in the lower region such that it can pivot about a pivot axis 4. For purposes of stability, washing tub 2 is provided with a U-section metal cross-member 5 similar to that which is shown in FIG. 2. The outer leg 6 of cross-member 5 forms the front boundary line of appliance housing 8. The outer leg is provided with a seal 9 which engages the upper edge of door 3. An insulating mat 10 is placed on the washing tub. A countertop 11 is located above dishwasher 1. The countertop is part of the row of kitchen cabinetry into which dishwasher 1 is integrated as a built-in or undercounter appliance. The front edge of countertop 11 projects over door 3 and will hereinafter be referred to as "overhang 12". The overhang may lie in the plane defined by the door front, or may project even further.

Dishwasher 1 also includes a condensation drying system for removing moisture from the warm, moist air that is present within the washing tub after the last water-using cycle step is completed. To this end, a fan 13 is provided in the lower side portion of dishwasher housing 8. The fan draws in cooling air (symbolized by arrows 15) through an opening 14 in appliance housing 8 below door 3 and passes it along a side wall of the washing tub.

Figure 4:
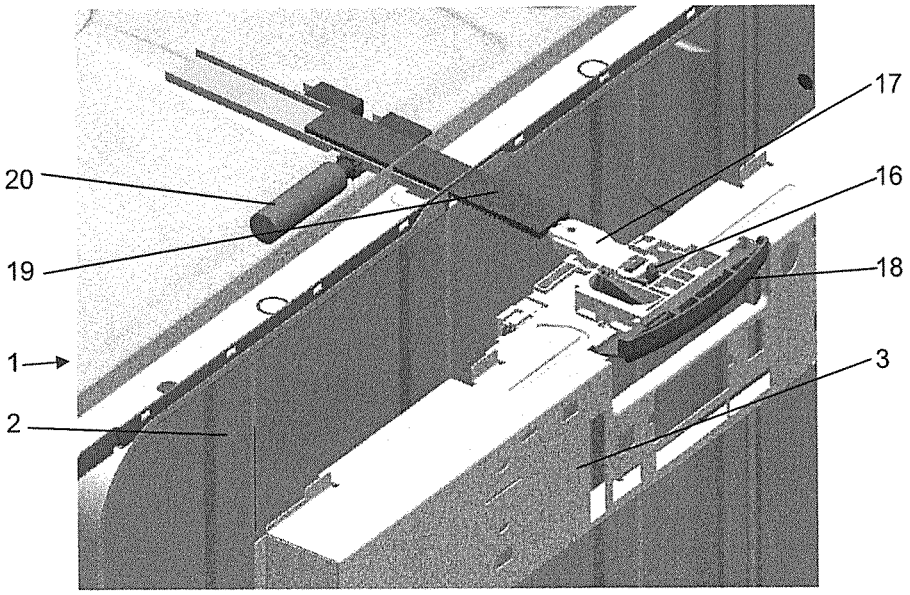
FIG. 4 is a view illustrating the closure mechanism of a dishwasher.

The dishwasher 1 is also equipped with a device for automatically opening the door to an ajar position at the end of the drying step, the upper portion of dishwasher 1 in a slightly open condition, similar to that shown in FIG. 4. To allow the closing of washing tub 2, a forked latch member 16 is rotatably mounted on door 3. When in the latching position, the latch member is in engagement with a latch keeper 17 mounted on the washing tub. To open the door, a handle 18 is pushed upward, causing latch member 16 to be rotated to a position in which it is no longer held by latch keeper 17. To enable door 3 to be opened in a program-controlled manner without actuation of handle 18, latch keeper 17 is attached to a closing plate 19 which can be linearly displaced by motor means over a distance of about ten centimeters in the opening direction of door 3. Motor 20 is energized by controller 30 of dishwasher 1 according to the programmed cycle.

Figure 1:
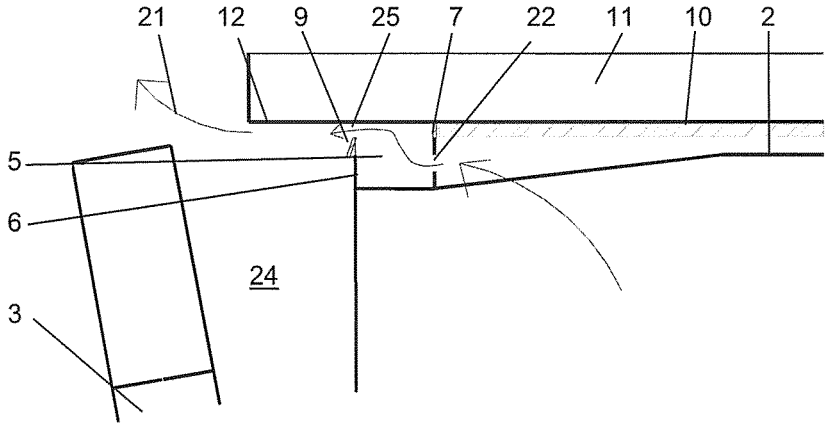
FIG. 1 is a view showing a portion of a dishwasher having an air flow path according to the present invention.

FIG. 1 shows a dishwasher in which, in accordance with the present invention, a partial air flow 21 is passed between the upper front edge of the washing tub and the upper boundary surface of the dishwasher housing along the underside of countertop overhang 12. To this end, rear leg 7 of cross-member 5 is perforated and front leg 6 is shortened, leaving a gap 25 between this leg 6 and countertop 11. Initially, fan 13 runs while door 3 is closed. As a result, cooling air 15 is discharged from housing 8 at the rear such as in FIG. 3. Since the space between washing tub 2 and appliance housing 8 is at a pressure slightly above atmospheric pressure, a partial air flow 21 exits at the front even while door 3 is closed. As a result, the underside of countertop overhang 12 is already in a pre-warmed condition when door is opened, so that condensation is thereby immediately and completely prevented. After a predetermined period of time, door 3 is automatically opened to leave a gap 24 while the fan continues to run.

Partial air flow 21 at the front diverts the steam emerging from the washing tub and keeps it away from countertop 11. Moreover, this partial air flow is warmed by the warm exterior wall of the washing tub as it passes therealong and, therefore, increases the temperature of countertop overhang 12. In other words, in the mixing zone underneath countertop 11, the dew-point temperature is below the temperature of the countertop, so that no condensation can occur. Fan 13 should continue to run until no more moist steam emerges from washing tub 2. This time can be determined experimentally.

While the invention has been particularly shown and described with reference to preferred embodiments thereof, it will be understood by those skilled in the art that various changes in form and details may be made therein without departing from the spirit and scope of the invention.

What is claimed is:

1. A method for carrying out a drying step in a dishwasher, the dishwasher including a housing, a washing tub, a door with a hinged tower region operable to close the washing tub, an opening device for automatically opening the door to an ajar position and a condensation drying system including a cooling air fan, the method comprising:

guiding, with the door in a dosed position, a portion of a cooling-air flow of the cooling air fan along a portion of an underside of a countertop covering a top of the dishwasher housing so as to pre-warm the portion of the underside of the countertop covering for preventing condensation thereon;

automatically opening the door to an ajar position using the opening device; and guiding a portion of the cooling-air flow of the cooling air fan along the portion of the underside of the countertop alter the door is opened so as to divert steam emerging from the washing tub away from the countertop.

2. The method as recited in claim 1, wherein the dishwasher is a domestic dishwasher.

3. The method as recited in claim 1, wherein the housing includes a cross member disposed at a top of the dishwasher housing, the cross member forming a guide, and wherein the guiding a portion of the cooling air with the door in the closed position is performed using the cross member.

4. The method as recited in claim 3, wherein the cross-member includes a U-section having a front leg and a rear leg.

5. The method as recited in claim 4, wherein the rear leg is perforated.

6. The method as recited in claim 4, wherein the front leg is disposed at a distance from the countertop so as to form a gap between the front leg and countertop.

7. The method as recited in claim 5, wherein the front leg is disposed at a distance from the countertop so as to form a gap between the from leg and countertop.

* * * * *